US009846012B2

(12) United States Patent
Crye et al.

(10) Patent No.: US 9,846,012 B2
(45) **Date of Patent: *Dec. 19, 2017**

(54) BALLISTIC NAPE PROTECTOR FOR BALLISTIC HELMET

(71) Applicant: LineWeight LLC, Brooklyn, NY (US)

(72) Inventors: Caleb Clark Crye, Brooklyn, NY (US); Eric Owen Fehlberg, Brooklyn, NY (US); Gregg M. Thompson, Brooklyn, NY (US)

(73) Assignee: LineWeight LLC, Brooklyn, NY (US)

( * ) Notice: Subject to any disclaimer, the term of this patent is extended or adjusted under 35 U.S.C. 154(b) by 89 days.

This patent is subject to a terminal disclaimer.

(21) Appl. No.: 14/970,005

(22) Filed: Dec. 15, 2015

(65) Prior Publication Data

US 2016/0146577 A1 May 26, 2016

Related U.S. Application Data

(63) Continuation of application No. 13/936,613, filed on Jul. 8, 2013, now Pat. No. 9,243,872, which is a (Continued)

(51) Int. Cl.
*F41H 1/00* (2006.01)
*F41H 1/04* (2006.01)
(Continued)

(52) U.S. Cl.
CPC ..... *F41H 1/04* (2013.01); *A42B 3/085* (2013.01); *A42B 3/105* (2013.01); *F41H 1/02* (2013.01)

(58) Field of Classification Search
CPC ... F41H 1/04; F41H 1/02; A42B 3/085; A42B 3/105
See application file for complete search history.

(56) References Cited

U.S. PATENT DOCUMENTS 2,814,043 A 11/1957 Alesi
2,888,681 A 6/1959 Stuart et al.
(Continued)

OTHER PUBLICATIONS

"ForceField TM Advanced Combat Helmut (ACH): Operation and Instructions", (C) 2006 Mine Safety Appliances Company, Pittsburgh, Pennsylvania.

(Continued)

*Primary Examiner* — Khaled Annis
(74) *Attorney, Agent, or Firm* — Stiennon & Stiennon

(57) ABSTRACT

A ballistic armored component attaches to the existing retention straps of common combat helmets and provides protection to the otherwise exposed lower skull and upper neck region. A fabric covering contains a soft armor or hard armor insert, and is mounted by straps or other fasteners to existing straps found in conventional helmets. The armor component may be fabric of aramid fibers, or fabric of ultra high molecular weight polyethylene fibers, or may be fabricated of a rigid plate of ceramic, polymer, or metal. The armored component adds additional protection from ground-level or subterranean munitions, by placing a ballistic shape on the lower skull region (occipital region), providing significant additional ballistic coverage with minimal weight and bulk. The fabric shell may also be connected directly to the helmet shell, to allow the component to withdraw within the helmet when the wearer's neck is flexed rearwardly.

18 Claims, 3 Drawing Sheets

Related U.S. Application Data continuation of application No. 11/681,399, filed on Mar. 2, 2007, now Pat. No. 8,505,113.

(60) Provisional application No. 60/778,552, filed on Mar. 2, 2006.

(51) Int. Cl.

| | |
|---|---|
| ***A42B 3/08*** | (2006.01) |
| ***A42B 3/10*** | (2006.01) |
| ***F41H 1/02*** | (2006.01) |

(56) References Cited

U.S. PATENT DOCUMENTS

| | | | | | |
|---|---|---|---|---|---|
| 3,039,108 | A | | 6/1962 | Lohrenz | |
| 3,046,560 | A | | 7/1962 | De Grazia | |
| 3,103,014 | A | | 9/1963 | Morgan | |
| 3,436,760 | A | | 4/1969 | Molitoris | |
| 3,551,910 | A | | 1/1971 | Raschke | |
| 3,591,863 | A | | 7/1971 | Rickard | |
| 3,609,763 | A | | 10/1971 | Raney | |
| 3,843,970 | A | | 10/1974 | Marietta et al. | |
| 3,852,821 | A | * | 12/1974 | Mickel | A42B 3/142 2/415 |
| 4,796,309 | A | | 1/1989 | Nava | |
| 5,471,683 | A | * | 12/1995 | Moretz | A42C 5/02 2/169 |
| 5,898,950 | A | | 5/1999 | Spyrou et al. | |
| 6,163,891 | A | | 12/2000 | Viitalahti | |
| 6,681,403 | B2 | | 1/2004 | Lyden | |
| 6,804,829 | B2 | | 10/2004 | Crye et al. | |
| 6,922,847 | B2 | | 8/2005 | Bachner, Jr. | |
| 7,124,449 | B2 | * | 10/2006 | Sutter | A42B 3/06 2/181 |
| 7,797,964 | B1 | | 9/2010 | Norris | |
| 7,827,617 | B2 | | 11/2010 | Trainor et al. | |
| 8,505,113 | B2 | | 8/2013 | Crye et al. | |
| 2004/0016036 | A1 | | 1/2004 | Bachner, Jr. | |
| 2004/0060100 | A1 | | 4/2004 | Reiterman | |
| 2005/0166303 | A1 | | 8/2005 | Aaron | |
| 2006/0248623 | A1 | * | 11/2006 | Miller | F41H 1/04 2/6.6 |
| 2009/0064385 | A1 | * | 3/2009 | Crossman | F41H 1/04 2/6.6 |

OTHER PUBLICATIONS

"Nape Protector for PASGT Style/General Duty Riot Helmets", (c) 2007 Gentex Corporation, http://www/gentexcorp.com/default.aspx?pageid+947, accessed Feb. 27, 2007.

U.S. Appl. No. 60/663,197, filed Mar. 21, 2005 to Crossman et al.

* cited by examiner

FIG. 1
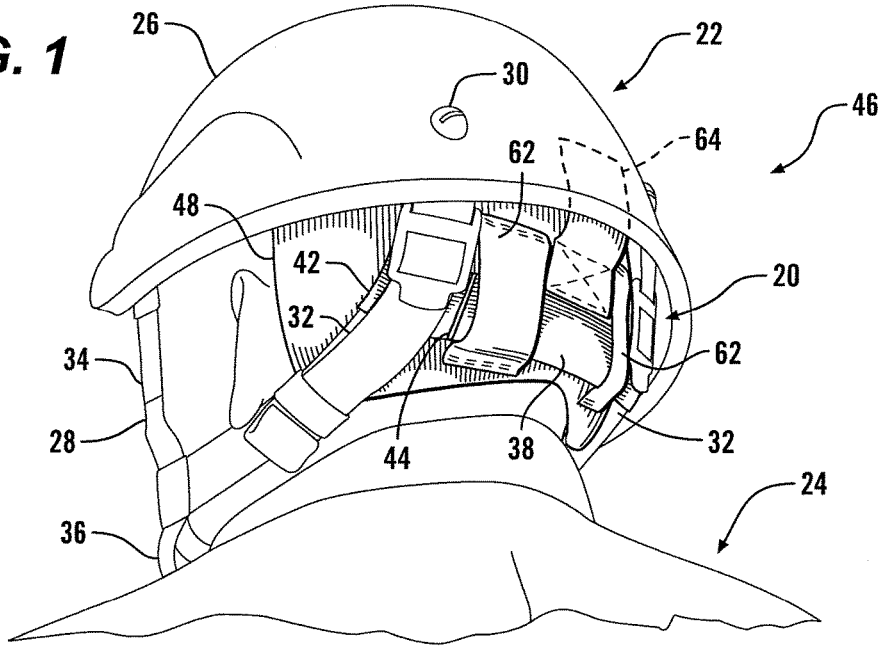
FIG. 2
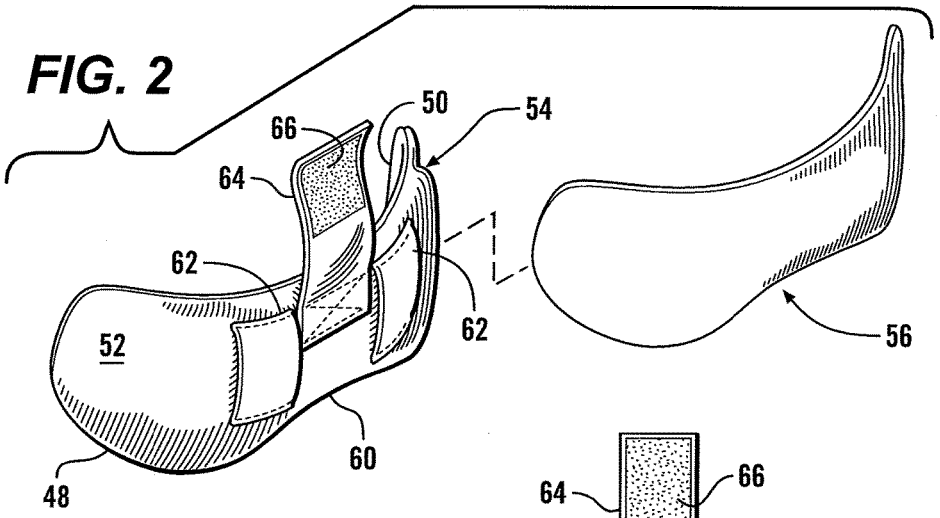
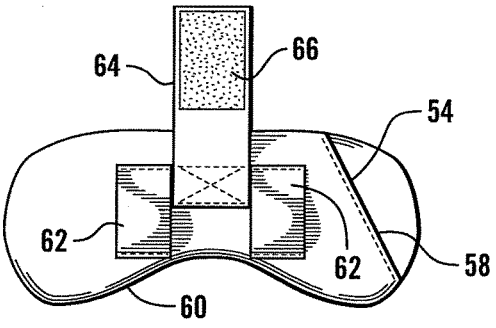
FIG. 3

BALLISTIC NAPE PROTECTOR FOR BALLISTIC HELMET

CROSS REFERENCES TO RELATED APPLICATIONS

This application is a continuation of U.S. application Ser. No. 13/936,613, filed Jul. 8, 2013, now U.S. Pat. No. 9,243,872, which is a continuation of U.S. application Ser. No. 11/681,399, filed Mar. 2, 2007, now U.S. Pat. No. 8,505,113, which claims benefit from U.S. provisional app. 60/778,552, filed Mar. 2, 2006, the disclosures of which applications are hereby incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to body armor systems worn for protection against projectile threats such as rifle and handgun bullets, and shrapnel.

Persons exposed to projectile threats, such as police officers and soldiers, may seek a certain level of protection by wearing armored clothing. Low velocity projectiles such as handgun rounds, fragmentation rounds from a grenade or mortar, and miscellaneous shrapnel may be countered by so-called "soft armor." Soft armor is worn in the form of jackets, vests, etc. which are composed of assemblies of ballistic fabric such as those formed from DuPont Kevlar® fibers or of Spectra® ultra high molecular weight polyethylene fibers from Honeywell. The soft armor is often fabricated as flexible panels which are received within pockets or pouches formed in fabric vests or jackets. In more serious threat situations, where higher velocity rifle rounds and fragments must be countered, soft armor has typically been supplemented with hard armor fabricated of rigid plates of ceramic, polymer, or metal.

Most Ballistic helmets in use today are flared at the lower edge. This shape makes the helmets easier to produce by allowing single direction molds and also aids in airflow under the helmet, and may in some circumstances allow greater range of motion. Although this flared shape may be helpful in defending against air-bursting munitions traveling downward toward the wearer from a point above, this shape leaves the serviceman's head exposed to projectiles coming from ground-level or subterranean munitions—a significant threat in certain modern conflict situations. A projectile from such a munition typically travels towards the wearer with an upward angle of incidence. A helmet with a flared lower edge exposes significant portions of the head and upper neck to this upwardly traveling threat.

What is needed is a ballistic helmet assembly which protects the lower skull and upper neck region of a wearer while preserving necessary range of motion, and which can be retrofitted to existing helmet systems.

SUMMARY OF THE INVENTION

The ballistic helmet assembly of this invention has a ballistic armored component that attaches to the existing retention straps of common combat helmets and provides protection to the otherwise exposed lower skull and upper neck region. The component may comprise a fabric coverings which contains a soft armor or hard armor insert. The component has straps or other fasteners which allow for removable attachment to existing straps found in conventional helmets. The invention adds additional protection from ground-level or subterranean munitions, by placing a ballistic shape on the lower skull region (occipital region). In doing so, a significant amount of ballistic coverage can be achieved with minimal weight and bulk. Moreover, replacement or new retention assemblies can be provided with the nape protecting component integrated therewith.

In some current combat situations, the primary threats being encountered are high speed fragments from ground-based explosions. While certain fragments cannot be stopped, even by thick steel plate, many fragments that would otherwise kill or severely injure a human can be stopped by an attached ballistic component, for example small fragments traveling at high speeds. Protecting the base of the skull protects large portions of the brain stem, cerebellum, occipital lobe, and temporal lobe. These regions control highly important functions. Breathing, sight, locomotion, and language are all functions that reside in this area.

It is an object of the present invention to provide a lightweight protective element which can assist in protecting soldiers from ground based or subterranean munitions.

It is an additional object of the present invention to provide a protective element for the base of the skull which can be rapidly attached to and removed from an existing helmet.

Further objects, features and advantages of the invention will be apparent from the following detailed description when taken in conjunction with the accompanying drawings.

BRIEF DESCRIPTION OF THE DRAWINGS

FIG. 1 is a rear perspective view, looking upwardly at the ballistic assembly of this invention installed in a U.S. Army Advanced Combat Helmet.

FIG. 2 is an exploded rear perspective view, looking downwardly at the nape protecting component of the assembly of FIG. 1, with the ballistic element shown exploded from its fabric covering.

FIG. 3 is a rear elevational view of the nape protecting component of FIG. 2.

DESCRIPTION OF THE PREFERRED EMBODIMENTS

Figure 4:
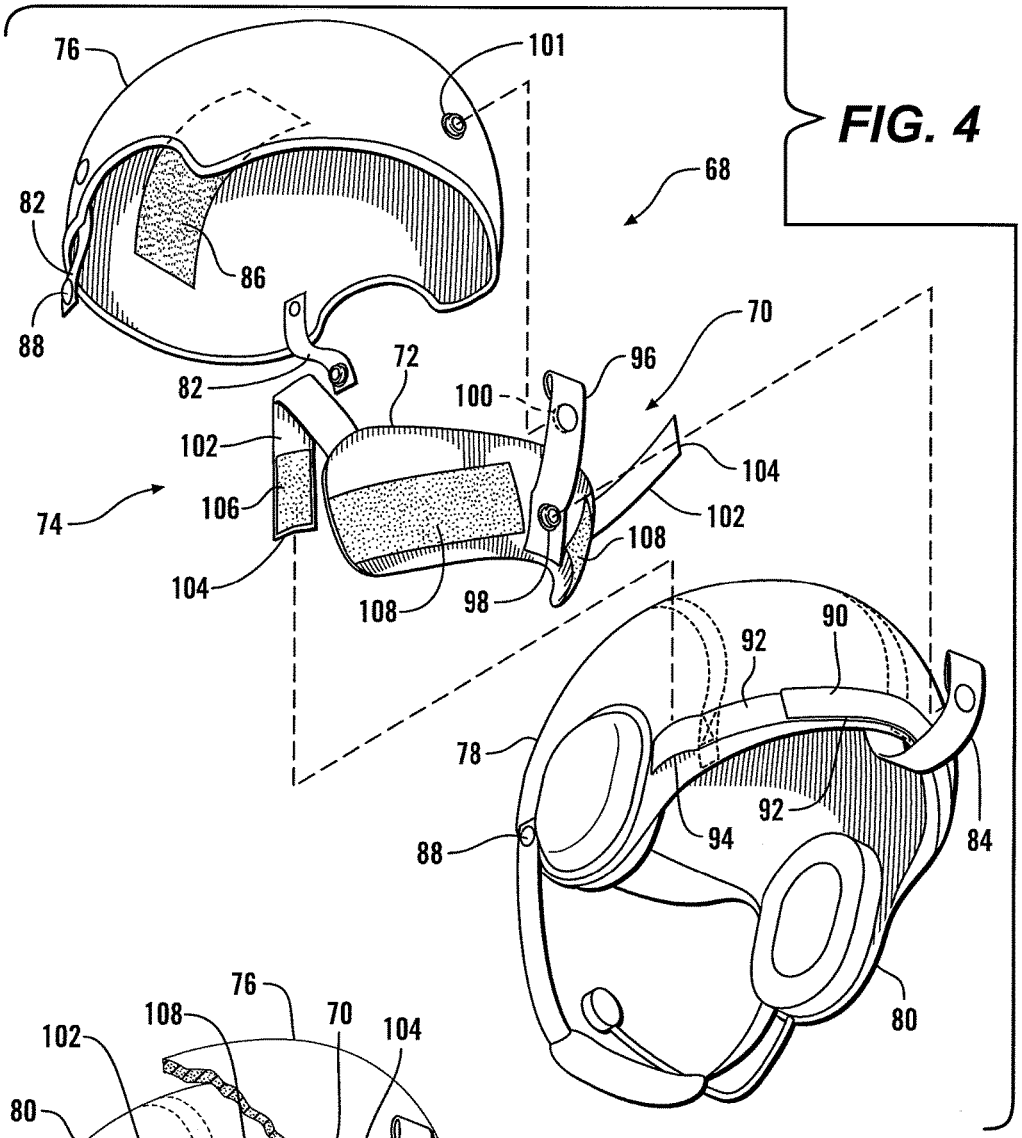
FIG. 4 is an exploded rear perspective view of a combat vehicle crewman helmet, showing the position of an alternative embodiment nape protective component of this invention.

Referring more particularly to FIGS. 1-8, wherein like numbers refer to similar parts, a nape protecting component 20 of this invention is mounted to a ballistic combat helmet 22 and is worn by a soldier 24. The nape protecting component 20 shown in FIGS. 1-3 is configured for use with a conventional US Army Advanced Combat Helmet (ACH) such as those manufactured by Mine Safety Appliances Company, of Pittsburgh, and shown in U.S. Pat. D449,411, the disclosure of which is incorporated by reference herein.

The ACH helmet has a stiff ballistic shell 26, i.e., an upper ballistic shell, provided with a helmet retention assembly comprising: a pad suspension system, not shown, and a chinstrap retention system 28 with hardware 30 which fastens the retention system to the shell. The chinstrap retention system 28 has two downwardly extending rear retention straps 32 or rear legs which are connected to the helmet ballistic shell 26 by the hardware 30, and which are provided with various buckles which permit the overall length of the retention straps to be adjusted. The rear retention straps 32 extend forwardly to be connected to two front retention straps 34 and a chin strap 36. The two rear retention straps 32 are connected by a nape strap 38, as shown in FIG. 1. The nape strap 38 is a sidewardly extending strap with a loop 42 on one end through which one of the rear retention straps 32 extend, the other end 44 of the nape strap extends behind the other rear retention strap, and is then folded back on itself and secured in place by a two-part hook and loop fastener such as VELCRO fastener manufactured by Velcro Industries B.V.

The conventional pad suspension system is comprised of a number of resilient pads which have one part of hook and loop fastener on the surface which faces the interior of the helmet shell. The interior of the shell is provided with an array of patches of the other part of the hook and loop fastener, such that the pads may be inserted and attached at the desired locations.

The nape protecting component 20 is readily connected to the conventional helmet assembly to form a ballistic helmet assembly 46 with added protection to the lower skull and nape of the neck. As best shown in FIG. 2, the nape protecting component 20 has a fabric covering 48 in an oblong shape, the covering has a front sheet 50 which is sewn to a rear sheet 52 to define a pocket 54 which receives a ballistic element 56 therein. By "ballistic element" is meant an element of soft or hard armor, configured to resist ballistic projectiles or fragments. The ballistic element 56 may be conventional soft armor, i.e., assemblies of ballistic fabric such as those formed from DuPont Kevlar® fibers, fibers of Spectra® ultra high molecular weight polyethylene fibers from Honeywell, or other ballistic material, or hard armor, for example elements fabricated of rigid plates of ceramic, polymer, or metal. Moreover, because the ballistic inserts are replaceable elements, the nape protecting component 20 may be readily updated with more advanced materials as they become available. A rifle-level protection is envisioned with enhanced materials, for example with ceramic or metal. The fabric covering 48 may be sewn with an upwardly extending slot or slit 58, as shown in FIG. 3, to permit the insertion and removal of the ballistic element 56. The front sheet 50 of the fabric covering may be a different material than the rear sheet 52, for example the front sheet may be a brushed perforated fabric such as spacer mesh to promote wicking and avoid abrasion to the back of the wearer's neck, while the rear sheet may be a more durable material such as nylon, cotton/nylon, or DuPont's NOMEX resistant meta-aramid material, or other fabric, and may have a camouflage design placed thereon.

The fabric covering with interior ballistic element 56 is longer than it is tall, for example about eight inches wide, and from two-and-a-half to three inches tall, however, it may be produced in a number of sizes to suit the range of servicemen who will use the device. Preferably, in order to preserve hearing, the component 20 will extend from behind one ear to just behind the other ear in the side to side direction, and will extend vertically from a position about one inch above the lower rim of the helmet shell to a position about one inch above the wearer's collar. The lower edge 60 of the fabric covering 48 may have a downwardly opening concave contour, to better conform to the wearer's neck. The entire component 20 may be somewhat flexible, depending on the composition of the ballistic element 56, but is generally concave towards the wearer, so that the sides of the component wrap around the head of the wearer.

As shown in FIGS. 2 and 3, two short upwardly extending strips of webbing are sewn to the rear sheet 52 of the fabric covering 48 to define two sidewardly spaced loops 62 or connecting elements, which are large enough to permit free end 44 of the nape strap 38 to be threaded therethrough. The loops 62 may be spaced about one-and-a-half inches apart. Between the two loops 62, a helmet mounting strap 64 is sewn to the rear sheet 52 of the fabric covering 48. The helmet mounting strap 64 or connecting element, as shown in FIG. 1, extends upwardly and has one part of a two-part hook and loop fastener, for example the loop part, on a rearwardly facing surface 66 for attachment to the interior of the helmet shell 26. The helmet mounting strap 64 may be, for example, about four inches long, extending about three inches upward from the fabric covering 48.

The nape protecting component 20 readily attaches to the existing helmet straps and is very unobtrusive to the wearer, while providing significant additional ballistic protection. To mount the component 20, the free end 44 of the conventional nape strap 38 is released from its hook-and-loop fastener attachment to itself. Typically, a conventional pad will be mounted on the nape strap 38, if so this pad may be removed and will not be needed when the nape protecting component 20 is in use. In addition, one of the helmet suspension pads, not shown, is temporarily removed from the rear interior surface of the helmet shell 26. The nape strap 38, which is connected at one end to a first rear retention strap 32, is threaded through the two loops 62, around the second rear retention strap 32, and then secured to itself with the hook-and-loop closure adjacent the first rear retention strap. The helmet mounting strap 64 is extended upwardly within the helmet shell 26, and is attached by pressing together the hook-and-loop fastener to a patch, not shown, on the interior of the helmet. The removed helmet suspension pad is then reattached, but at least one inch above the termination of the helmet mounting strap 64, thereby leaving a space for the nape protecting component 20 to slide upwardly into the helmet when the wearer arches back his neck.

The illustrated nape protecting component is sized to allow the wearer to use earphone-based communications equipment. It may extend downwardly a greater distance, although with some interference with neck mobility. An enlarged nape protecting component may be employed where additional protection is required, and the loss in mobility and versatility is acceptable.

Figure 5:
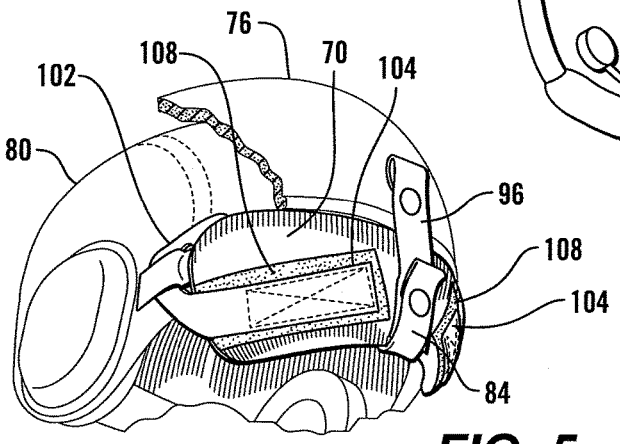
FIG. 5 is a rear perspective view of the assembly of FIG. 4, with the helmet shell partially broken away in section, shown the attachment of the nape protective component to the cap.

An alternative embodiment ballistic helmet assembly 68 is shown in FIGS. 4 and 5. The nape protecting component 70, like the component 20 discussed above, has a fabric covering 72 with a ballistic element contained therein, not shown. The fabric covering 72 also has an upwardly extending slot, not shown, which is positioned on the front surface of the fabric covering to permit the insertion and removal of the ballistic element. The nape protecting component 70 is configured to work with a conventional two-part helmet system 74 such as the combat vehicle crewman (CVC) helmet, such as is available from Sonetronics, West Belmar, N.J., which has a ballistic shell 76, i.e., an upper ballistic shell, to which is mounted a flexible liner or cap 78 having an integral headset 80 with attached microphone. The cap 78 is connected to the shell 76 by two front retention straps 82, which are fixed at one end to the shell; a single rear retention strap 84 which is fixed at one end to the cap; and a two-part hook and loop fastener having a patch on the top of the cap, not shown, and a patch 86 on the underside of the helmet shell 76. Each retention strap 82, 84 has one element of a two-part snap fastener 88 on its free end.

The cap 78 has a rear nape strap 90 or first member, which is comprised of two separate nape strap segments 92 which are sewn to the cap at one end, and which have overlapping hook and loop fastener to permit the length of the nape strap 90 to be adjusted. Adjacent the fixed ends of the nape strap segments 92 are loops 94 of the nape strap segments which open upwardly and downwardly, near each headset 80 speaker 95.

The nape protecting component 70 forming ballistic armor assembly, has an upwardly extending helmet mounting strap 96 with the male part 98 of a two-part snap fastener mounted at the base of the strap where it is fixed to the fabric covering 72 of the nape protecting component. The free end of the helmet mounting strap 96 has the female part 100 of a two-part snap fastener mounted thereto. As shown in FIG. 5, the cap rear retention strap 84 extends from the cap and is snapped into engagement with the snap 98 on the mounting strap, and is thus not connected directly to the helmet shell. The helmet mounting strap 96 free end is snapped into engagement with the snap fastener 101 on the helmet shell intended for the cap rear retention strap 84.

The nape protecting component 70 has two flexible straps 102 that extend from the front of the fabric covering 72 at about a 45 degree angle from the vertical. Each strap 102 is about five and one-half inches long and extends downwardly through one of the nape strap segment 92 loops 94 on the cap 78. Each strap 102 passes through a loop 94, and is then reversed to extend upwardly and overlie the rear surface of the fabric covering. Each strap 102 free end 104 has a patch 106 of one part of a hook and loop fastener, and is secured in place by engaging with a patch 108 of the other part of the hook and loop fastener which is fixed to the rear surface of the fabric covering, extending upwardly at about a 45 degree angle, and about three and one-half inches long. The nape protecting component 70 is thus readily attached to the helmet system 74 in such a way that it can be displaced upwardly on the interior of the helmet shell, but yet is still prevented from descending too low, or moving undesirably to the side.

Figure 7:
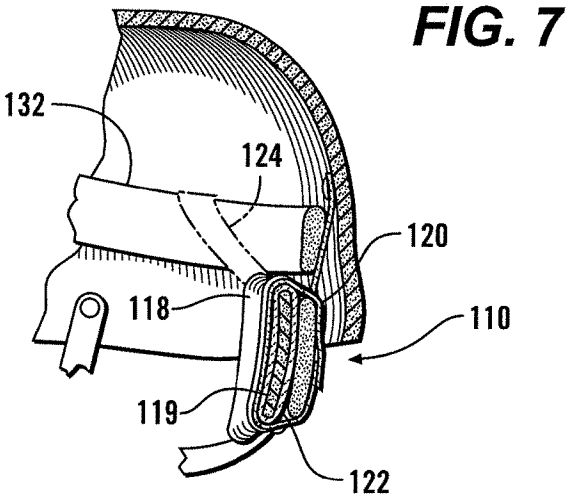
FIG. 7. is a fragmentary side cross-sectional view of the helmet of FIG. 6 with an alternative embodiment nape protecting component attached to the nape pad of the helmet retention assembly.
Figure 8:
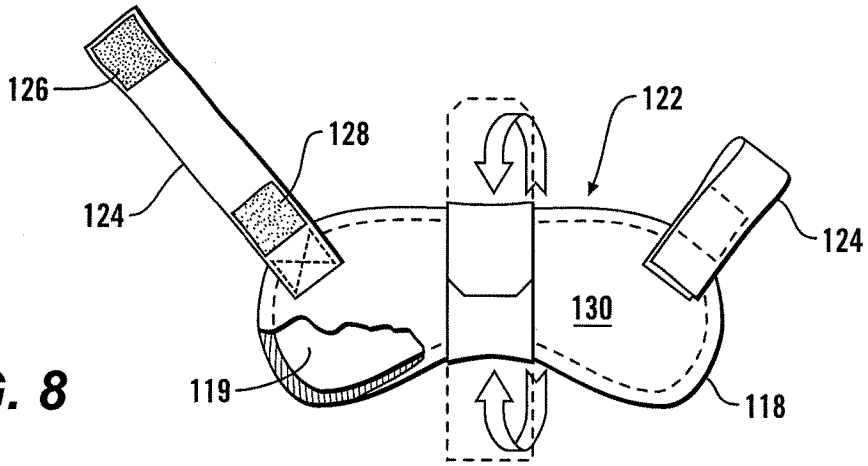
FIG. 8 is a rear elevational view of an alternative embodiment nape protecting component, adding side straps to the nape protecting component of FIG. 7, partially broken away in section to show the ballistic element therein.
Figure 6:
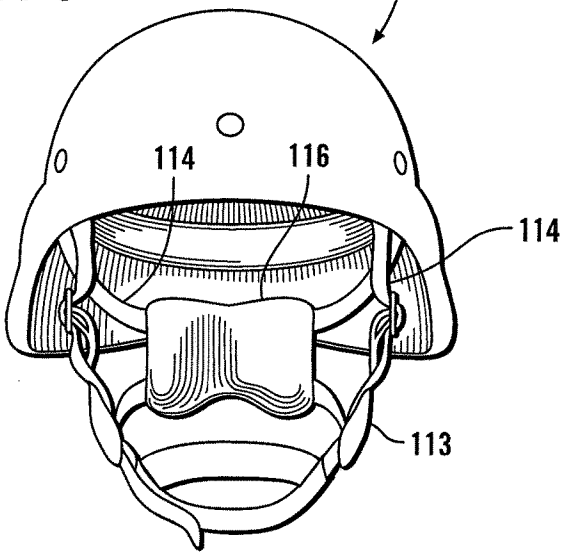
PRIOR ART FIG. 6
FIG. 6 is a front perspective view of a U.S. Marine Corps helmet.

Another alternative embodiment nape protecting component 110, i.e., a ballistic armor assembly, is shown in FIG. 7 for use with a prior art helmet such as the USMC LW helmet 112, shown in FIG. 6. Such a helmet 112 is manufactured by Gentex Corporation of Simpson, Pa., for the United States Marine Corps, and has a four-point retention harness 113 with two downwardly extending retention straps 114 with a standard nape pad 116 attached thereto which collectively form a helmet retention assembly. The nape pad 116 also constitutes a strap, although in this case it has a cushioning padding. A variation 122 of the ballistic armor assembly component for the helmet 112, which is identical to the component 110 but a larger size with side straps or connecting elements 124, is shown in FIG. 8. The nape protecting component 110, as shown in FIG. 7 has a fabric covering 118 similar in shape to the nape protecting components discussed above, with a similar ballistic element 119 retained therein. The nape protecting component 110 is secured to the retention harness 113 by two attachment straps 120, 121 which are sewn to the fabric covering 118 in the center of the component 110. The first attachment strap or connecting element 120 is attached along an upper seam, and the second attachment strap 121 is attached along a lower seam, and each of the attachment straps has one half of a hook and loop fastener, such that when the fabric covering and ballistic element 119 are positioned frontwardly of the helmet's nape pad 116, the two attachment straps encircle the nape pad and are secured to one another to position the nape protecting component as desired.

For use with larger size USMC LW helmets, a nape protecting component 122, similar to the component 110 is used, but which is larger and provided with two side attachment straps 124, as shown in FIG. 8. Each side attachment strap 124 extends upwardly and outwardly from the fabric covering, and has a first patch 126 and a second patch 128 of mating hook and loop material. Alternatively, the second patch may be sewn to the rearwardly facing surface 130 of the fabric covering 118. As shown in phantom view in FIG. 7, the side attachment straps 124 extend upwardly and loop around existing straps or bands 132 which extend rearwardly from the front retention harness attachment points to the rear attachment points. The side attachment straps 124 are then looped back on themselves to form closed loops.

It should be noted that various alternative closures and fastening assemblies may be used in place of the hook and loop fasteners shown, for example where appropriate snaps, ties, buttons, quick-release plastic buckles or clips, metal or plastic buckles, and lacing.

It should be noted that the ballistic element may be formed as a stack of multiple layers of ballistic material, for example material of Kevlar® fibers. Or, for example, layers of Spectra® fiber material may be stitched around the periphery to form a stiffer ballistic element. If additional stiffness is desired, a stiffening formed plastic element may be employed with the ballistic element, or may be adhered or stitched to the ballistic element as disclosed in U.S. Pat. No. 6,892,392, the disclosure of which is incorporated by reference herein. The stitching may be around the perimeter, or in a quilted or other pattern. The greater stiffness of the nape protecting component can help in stabilizing the entire helmet assembly, simply by providing a greater stable surface area against the head. This can be particularly advantageous when equipment is mounted to the front of the helmet, such as night vision goggles, etc.

It should be further noted that the ballistic element may be enclosed in a sewn lightweight fabric bag, to protect it from abrasion and soiling.

It is understood that the invention is not limited to the particular construction and arrangement of parts herein illustrated and described, but embraces all such modified forms thereof as come within the scope of the following claims.

We claim:

1. A helmet and ballistic armor assembly for protecting portions of a lower skull and an upper neck region of a wearer against ballistic projectiles and shrapnel, comprising:

a protective helmet having an upper ballistic shell, and a helmet retention assembly having two downwardly extending rear retention straps which are connected to the shell and which extend downwardly below the shell at a rear of the helmet, the helmet retention assembly having a first member which extends between and is connected to the two rear retention straps;

a ballistic armor assembly comprising:

a ballistic armor element formed of ballistic material, the ballistic material being selected from the group consisting of: fabric of aramid fibers, and fabric of ultra high molecular weight polyethylene fibers; and connecting elements connected to the ballistic armor element which engage portions of the helmet retention assembly two rear retention straps or first member, the ballistic armor assembly thereby being connected to the retention assembly for movement with respect to the shell so the ballistic armor assembly may slide upwardly into the shell when the wearer's neck is arched back.

2. The ballistic armor assembly of claim 1 further comprising a first fastener fixed to a flexible first strap which extends upwardly from the ballistic armor assembly, the first fastener connected to the upper ballistic shell, and being flexible to allow the ballistic armor element to be displaced upwardly within the upper ballistic shell of the protective helmet.

3. The ballistic armor assembly of claim 2 wherein the first fastener comprises one part of a hook and loop fastener, the other part of the hook and loop fastener being secured to the interior of the upper ballistic shell.

4. The ballistic armor assembly of claim 2 further comprising two loops spaced from each other mounted rearwardly from and connected to the ballistic armor assembly, the two loops receiving therein the first member which is connected at each end to a downwardly extending one of the rear retention straps.

5. A helmet and ballistic armor assembly for protecting portions of a lower skull and an upper neck region of a wearer against ballistic projectiles and shrapnel, comprising:

a protective helmet having an upper ballistic shell, and a helmet retention assembly having two downwardly extending rear retention straps which are connected to the shell and which extend downwardly below the shell at a rear of the helmet, the helmet retention assembly having a first member which extends between and is connected to the two rear retention straps;

a ballistic armor assembly comprising:

a covering defining a pocket therein, the covering configured to extend along the rear and opposite sides of a head of the wearer;

a ballistic armor element comprised of soft or hard armor configured to resist ballistic projectiles or fragments, wherein the ballistic armor element is received within the pocket; and a plurality of straps connected to the covering which engage portions of the helmet retention assembly two rear retention straps or first member, the ballistic armor assembly thereby being connected to the retention assembly for movement with respect to the shell so the ballistic armor assembly may slide upwardly into the shell when the wearer's neck is arched back.

6. The ballistic armor assembly of claim 5 further comprising a slit opening in the covering through which the ballistic armor element is insertable into an interior of the covering.

7. The ballistic armor assembly of claim 5 further comprising two auxiliary loops which extend upwardly and sidewardly from the covering and which each engage portions of the helmet retention assembly.

8. The ballistic armor assembly of claim 5 further comprising a first fastener fixed to a flexible first strap which extends upwardly from the ballistic armor assembly, the first fastener connected to the upper ballistic shell, and being flexible to allow the ballistic armor element to be displaced upwardly within the upper ballistic shell of the protective helmet.

9. The ballistic armor assembly of claim 8 wherein the first fastener comprises one part of a hook and loop fastener, the other part of the hook and loop fastener being secured to the interior of the upper ballistic shell.

10. The ballistic armor assembly of claim 5 further comprising two loops spaced from each other mounted to a rear of the covering, the two loops receiving therein the first member which is connected at each end to a downwardly extending one of the rear retention straps.

11. A helmet and ballistic armor assembly for protecting portions of a lower skull and an upper neck region of a wearer against ballistic projectiles and shrapnel, comprising:

a protective helmet having an upper ballistic shell, a flexible cap received within the upper ballistic shell and having loops attached thereto which open upwardly and downwardly;

a ballistic armor assembly comprising:

a covering defining a pocket therein, the covering configured to extend along the rear and opposite sides of a head of the wearer;

a ballistic armor element comprised of a stack of multiple layers of ballistic material, the ballistic material being selected from the group consisting of: fabric of aramid fibers, and fabric of ultra high molecular weight polyethylene fibers, wherein the ballistic armor element is received within the pocket; and a plurality of straps connected to the covering, wherein one of said straps engages each of the cap loops, and one of said straps comprises a mounting strap which directly engages the upper ballistic shell, the ballistic armor assembly thereby being connected for movement with respect to the shell so the ballistic armor assembly may slide upwardly into the shell when the wearer's neck is arched back.

12. The assembly of claim 11 wherein the mounting strap extends upwardly from the covering, and having attached thereto one half of a two-part snap fastener, the other half of the two-part snap fastener being fixed to an exterior of the upper ballistic shell.

13. The assembly of claim 11 further comprising a slit opening in the covering through which the ballistic armor element is insertable into an interior of the covering.

14. The assembly of claim 11, wherein the covering has a front sheet comprised of a spacer mesh positioned towards a helmet front.

15. A method for providing a helmet with ballistic armor for protecting portions of a lower skull and an upper neck region of a wearer against ballistic projectiles and shrapnel, the method comprising:

engaging a protective helmet having an upper ballistic shell, and a helmet retention assembly having two downwardly extending rear retention straps which are connected to the shell and which extend downwardly below the shell at a rear of the helmet, the helmet retention assembly having a first member which extends between and is connected to the two rear retention straps, the retention assembly having connected thereto a nape pad at the rear of the helmet;

attaching a ballistic armor assembly comprising a ballistic armor element formed of ballistic material comprising soft armor or hard armor to the helmet retention assembly two rear retention straps or first member in a manner which permits movement of the ballistic armor element with respect to the upper ballistic shell so the ballistic armor assembly may slide upwardly into the shell when a wearer's neck is arched back.

16. The method of claim 15 wherein the ballistic material is selected from the group consisting of: fabric of aramid fibers, and fabric of ultra high molecular weight polyethylene fibers.

17. The method of claim 15 wherein the step of attaching the ballistic armor assembly is preceded by removing the nape pad from its position connected to the retention assembly and replacing the removed nape pad with the ballistic armor assembly.

18. The method of claim 15 wherein the step of attaching the ballistic armor assembly comprises positioning the ballistic armor assembly frontwardly of the nape pad and securing it with respect thereto.

* * * * *